US011804670B1

(12) United States Patent
Robbins et al.

(10) Patent No.: US 11,804,670 B1
(45) Date of Patent: Oct. 31, 2023

(54) ELECTRICAL SIGNAL CONNECTOR RECEPTACLE ASSEMBLY FOR USE WITH ACCESS PORT

(71) Applicant: The United States of America as Represented by the Secretary of the Navy, Indian Head, MD (US)

(72) Inventors: Jennifer Robbins, Randolph, NJ (US); Matthew Boyer, Califon, NJ (US); Elizabeth Lee, Budd Lake, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 144 days.

(21) Appl. No.: 17/300,662

(22) Filed: Sep. 17, 2021

(51) Int. Cl.

| | |
|---|---|
| ***H01R 13/622*** | (2006.01) |
| ***H01R 24/76*** | (2011.01) |
| ***H01R 13/60*** | (2006.01) |
| ***H01R 13/52*** | (2006.01) |
| ***H01R 13/502*** | (2006.01) |

(52) U.S. Cl.
CPC ..... *H01R 13/622* (2013.01); *H01R 13/502* (2013.01); *H01R 13/5219* (2013.01); *H01R 13/60* (2013.01); *H01R 24/76* (2013.01)

(58) Field of Classification Search
CPC ..... H01R 13/622; H01R 13/502; H01R 13/5219; H01R 13/60; H01R 24/76
See application file for complete search history.

(56) References Cited

U.S. PATENT DOCUMENTS

| | | | | |
|---|---|---|---|---|
| 3,094,364 | A | 6/1963 | Lingg | |
| 6,442,899 | B1 | 6/2002 | Miyazaki | |
| 6,679,726 | B1 | 1/2004 | Tunn et al. | |
| 6,945,814 | B2 * | 9/2005 | Snape | H01R 35/02 439/165 |
| 7,326,063 | B1 | 2/2008 | Raudenbush et al. | |
| 9,004,928 | B2 | 4/2015 | Tanaka et al. | |
| 9,570,851 | B2 | 2/2017 | Rauscent et al. | |
| 9,780,508 | B2 | 10/2017 | Trapp | |
| 10,714,854 | B2 * | 7/2020 | Peng | H01R 13/187 |
| 11,462,853 | B2 * | 10/2022 | Yuan | H01R 43/20 |

(Continued)

FOREIGN PATENT DOCUMENTS

WO WO-9624035 A1 * 8/1996 ..... G01K 1/16

*Primary Examiner* — Peter G Leigh
*Assistant Examiner* — Nader J Alhawamdeh
(74) *Attorney, Agent, or Firm* — Fredric J Zimmerman

(57) ABSTRACT

An electrical signal connector receptacle assembly includes an annular mounting member configured for rigid attachment to a structure. The annular mounting member has a front end having a front opening and a rear portion. A connector ring is rotatably attached to the annular mounting member such that the connector ring rotates with respect to the annular mounting member. The connector ring is configured to be removably and rotatably attached to the electrical signal connector. In an exemplary embodiment, the connector ring is configured for threaded engagement with the electrical signal connector. The connector ring includes an interior region within which the annular mounting member is located and a front end having a front opening and a rear end having a rear opening. The rear portion of the annular mounting member extends through the rear opening of the connector ring and is configured to be attached to the structure.

24 Claims, 16 Drawing Sheets

(56) References Cited

U.S. PATENT DOCUMENTS

| | | | | |
|---|---|---|---|---|
| 2017/0149166 | A1 | 5/2017 | Mann et al. | |
| 2019/0237889 | A1* | 8/2019 | Peng | H01R 13/641 |
| 2020/0171681 | A1 | 6/2020 | Copley | |
| 2021/0273368 | A1* | 9/2021 | Yuan | H01R 43/18 |

* cited by examiner

ELECTRICAL SIGNAL CONNECTOR RECEPTACLE ASSEMBLY FOR USE WITH ACCESS PORT

STATEMENT OF GOVERNMENT INTEREST

The invention described herein may be manufactured and used by or for the government of the United States of America for governmental purposes without the payment of any royalties thereon or therefor.

TECHNICAL FIELD

The disclosure herein general pertains to an electrical signal connector receptacle assembly.

BACKGROUND

Electronic systems are typically housed within containers or housings. Many times, it is necessary to perform diagnostic tests on the electronic systems. Often, the electronic system has a built-in test (BIT) cable that is located within the container. In order to retrieve the BIT cable, a technician would have to open or disassemble the container. Opening or disassembling the container can be a time-consuming and tedious task. Once the technician retrieves the BIT cable, the technician electrically connects the BIT cable to the test equipment in order to perform the diagnostic test. In some electronic systems, the electrical connector of the BIT cable is mounted within the container to the inside wall or other internal support structure. This configuration would necessitate opening or disassembling the container and connecting an external electrical cable to the electrical connector of the BIT cable. The external electrical cable is attached to the test equipment. Not only is this a time consuming process, but many times, it is difficult to align the electrical connector of the external electrical cable with the electrical connector of the BIT cable resulting in damage to electrical connector pins. Conventional access ports were developed to allow external cables to be inserted into the container or to allow internal cables connected to the electronic system to be fed through the access port in order to be connected to test equipment. However, the conventional access ports do not eliminate the need to open or disassemble the container.

Since the current trend is to provide electronic systems with BIT cables for diagnostic testing, what is needed is a new and improved access port that significantly reduces the time for such diagnostic testing and also facilitates updating and repair of electronic systems in a timely manner.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

In some exemplary embodiments, an electrical signal connector receptacle assembly includes an annular mounting member configured for attachment to a structure such that the annular mounting member is stationary with respect to the structure. The electrical signal connector receptacle assembly further includes a connector ring rotatably attached to the annular mounting member such that the connector ring rotates with respect to the annular mounting member. The connector ring has an interior region within which the annular mounting member is located. The connector ring is configured to be removably connected to an electrical signal connector. In some embodiments, the connector ring includes a threaded area that is configured for threaded engagement with a threaded area of the electrical signal connector. The connector ring includes a front end having a front opening and a rear end having a rear opening. The annular mounting member has a portion that extends through the rear opening of the connector ring and is configured for attachment to the structure. The annular mounting member includes a front end located within the interior region of the connector ring. An O-ring gasket is positioned within the interior region of the connector ring and is adjacent to the front end of the mounting member. The O-ring gasket is configured to contact the electrical signal connector when the connector ring is fully connected to the electrical signal connector.

In some exemplary embodiments, a system comprises an annular housing configured to be removably mounted within an opening in a container wall. The annular housing has a front opening, a rear opening and an interior region in communication with the front opening and rear opening. The front opening, rear opening and interior region are sized to allow passage therethrough of an electrical cable. An annular fastener member is removably attached to the annular housing to retain the annular housing within the opening in the container wall. A cover assembly is removably attached to the annular housing so as to cover the front opening. The cover assembly includes a central member having a front side and a rear side that confronts the interior region of the annular housing. An electrical signal connector receptacle assembly is attached to the rear side of the central member such that the electrical signal connector receptacle assembly is located within the interior region of the annular housing. The electrical signal connector receptacle assembly includes a connector ring that is configured to be removably attached to an electrical signal connector of the electrical cable.

In some embodiments, a system comprises an annular housing configured to be removably mounted within an opening in a container wall. The annular housing has a front opening, a rear opening and an interior region in communication with the front opening and rear opening. The front opening, rear opening and interior region are sized to allow passage therethrough of an electrical cable. An annular fastener member is removably attached to the annular housing so as to retain the annular housing within the opening in the container wall. A cover assembly is removably attached to the annular housing so as to cover the front opening. The cover assembly includes a central member having a front side, a rear side that confronts the interior region of the annular housing and a collar rotatably attached to the central member such that the collar is rotatable about the central member. The collar is removably attached to the annular housing. The collar and the annular housing are configured to allow the cover assembly to be removed from the annular housing by rotating the collar in a first direction and secured to the annular housing by rotating the collar in an opposite second direction. A flexible member is attached to the collar and the annular housing so that the cover assembly remains attached to the annular housing when the cover assembly is removed from the annular housing so as to prevent the cover assembly from becoming lost or damaged. The system further includes an electrical signal connector receptacle assembly attached to the rear side of the central member such that the electrical signal connector receptacle assembly is located within the interior region of the annular housing.

The electrical signal connector receptacle assembly includes a rotatable connector ring that is configured to be removably attached to an electrical signal connector of the electrical cable.

In another exemplary embodiment, a container for housing an electronic system is disclosed herein. The container comprises a plurality of container walls configured to define an interior region. Each container wall has an interior side and an exterior side and wherein one of the container walls has an opening therein. An electrical test cable is positioned within the interior region of the container and in electrical signal communication with the electronic system. The electrical test cable includes an electrical signal connector having a threaded surface. The container further comprises an access port mounted within the opening in one of the container walls. The access port comprises an annular housing mounted within the opening in the container wall. The annular housing has a front opening, a rear opening and an interior region in communication with the front opening and the rear opening. The rear opening of the annular housing is also in communication with the interior region of the container. The front opening, rear opening and interior region of the annular housing are sized to allow passage therethrough of the electrical test cable. The annular housing includes a first section that is external to the interior region of the container and which has the front opening. The annular housing further comprises a second section that is located within the interior region of the container and which has the rear opening. The first section of the annular housing is configured to abut the exterior side of the container wall. The access port further comprises an annular fastener member that is located within the interior region of the container and is removably attached to the second section of the annular housing so as to retain the annular housing within the opening in the container wall. The access port further comprises a cover assembly that is removably attached to the first section of the annular housing so as to cover the front opening. The cover assembly includes a central member having a front side and a rear side that confronts the interior region of the annular housing. The access port further comprises an electrical signal connector receptacle assembly that is attached to the rear side of the central member such that the electrical signal connector receptacle assembly is located within the interior region of the annular housing. The electrical signal connector receptacle assembly comprises a connector ring that is removably and rotatable attached to the electrical signal connector of the electrical test cable. Rotating the connector ring in a first direction with respect to the electrical signal connector disconnects the electrical signal connector from the connector ring and rotating the connector ring in an opposite second direction connects the connector ring to the electrical signal connector. The electrical signal connector of the electrical test cable remains connected to the connector ring as the cover assembly is removed from the first section of the annular housing thereby withdrawing the electrical test cable from the interior of the container without a technician having to open the container in order to retrieve the electrical test cable. Once the electrical signal connector of the electrical test cable is positioned outside of the container, the technician may rotate the connector ring in the first direction so as to disconnect the electrical signal connector from the connector ring in order to connect the electrical signal connector to external test equipment in order perform diagnostic tests on the electronic system.

DETAILED DESCRIPTION

As used herein, the terms "comprise", "comprising", "comprises", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

As used herein, terms such as "vertical", "horizontal", "top", "bottom", "upper", "lower", "middle", "above", "below" and the like are used for convenience in identifying relative locations of various components and surfaces relative to one another in reference to the drawings and are not intended to be limiting in any way.

In order to facilitate understanding of electrical signal connector receptacle assembly and its benefits and advantages, the ensuing description is in terms of electrical signal connector receptacle assembly being part of an access port system. However, it to be understood that electrical signal connector receptacle assembly disclosed herein may be used with a variety of other types of devices, machines and systems.

Figure 1:
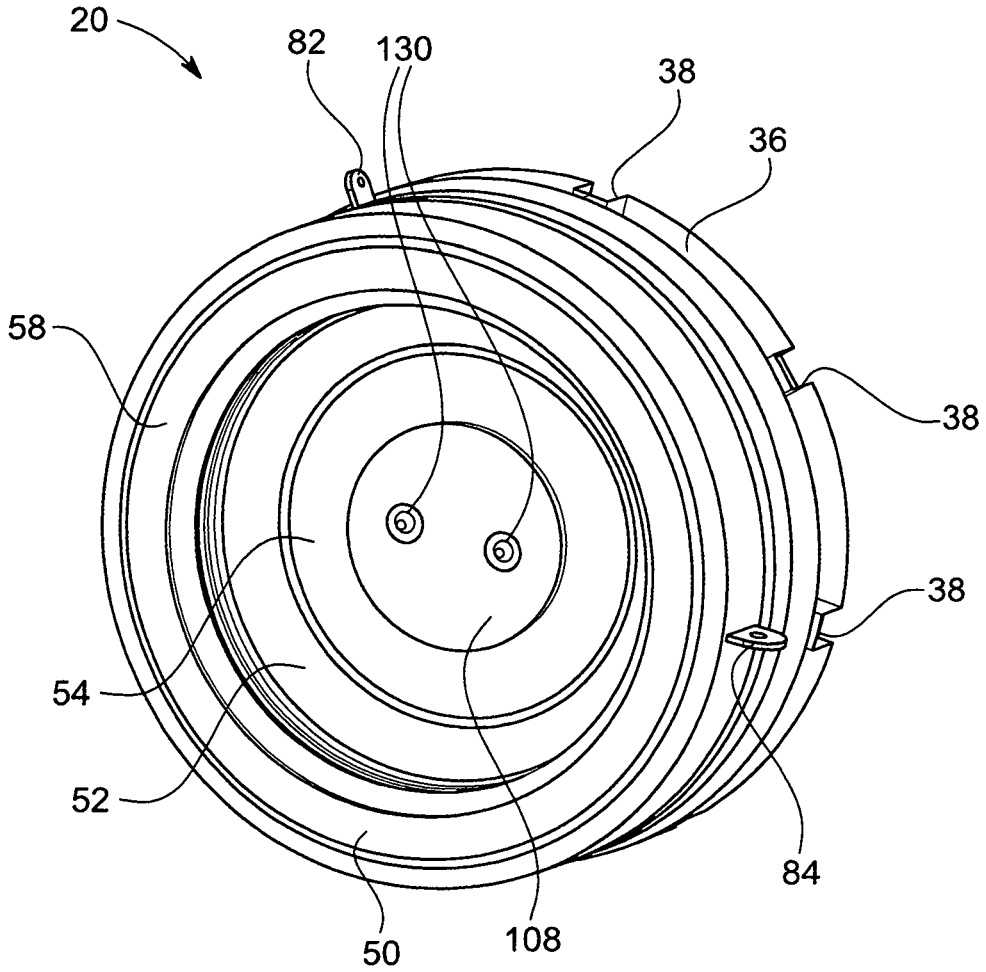
FIG. 1 is a front, perspective view of an access port having an electrical signal connector receptacle assembly in accordance with an exemplary embodiment.
Figure 2:
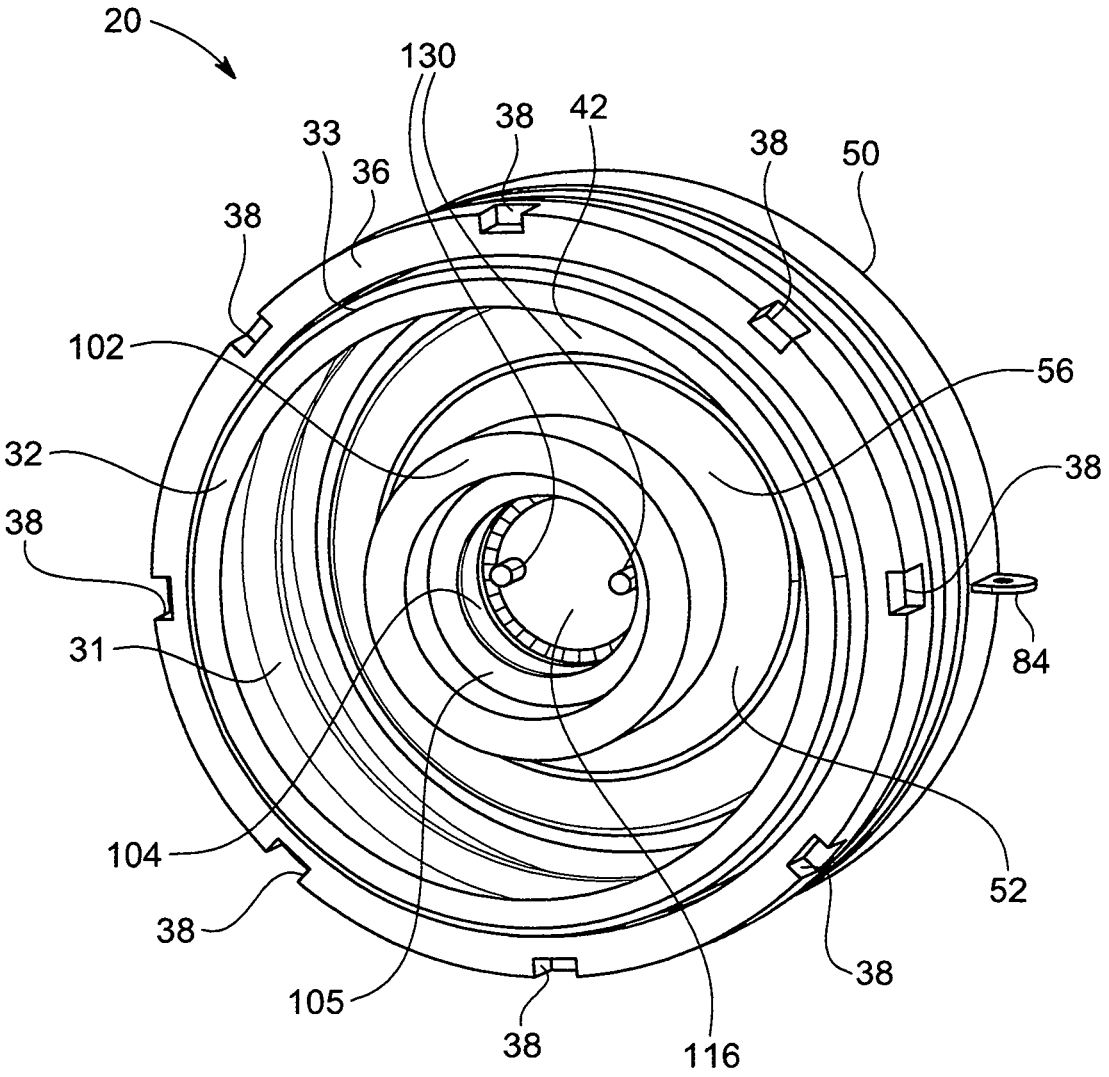
FIG. 2 is a rear, perspective view of the access port.

Referring to FIGS. 1, 2, 3A, 3B, 7 and 8, there is shown access port system 20 that incorporates an electrical signal connector receptacle assembly in accordance with an exemplary embodiment. Access port system 20 is configured to be used with container 22 that contains or houses an electronic system. The electronic system may be any type of electronic system. Examples of such electronic systems include, but are not limited to, data storage or computer systems, electronically controlled machinery, robotic devices, radar and sonar systems and weapons system. Container 22 includes a plurality of walls 24 that define interior region 25 of container 22. The electronic system is located within interior region 25. Each container wall 24 has exterior side 26 and interior side 28. Access port system 20 comprises annular housing 30 that is configured to be removably positioned or mounted within an opening in container wall 24. Annular housing 30 has an interior region 31 that is sized to receive an electrical cable. Annular housing 30 includes section 32 that extends through the opening in container wall 24 into interior region 25 of container 22. In an exemplary embodiment, section 32 has threaded portion 33. Annular housing 30 further includes section 34 that is located external to container 22 and is configured so that it abuts exterior side 26 of container wall 24. Annular housing 30 further comprises annular member 36 that is configured to be threadedly engaged with threaded area 33. Annular housing 30 is tightly secured to container wall 24 by tightening annular member 36. When annular member 36 is completely fastened to section 32, annular member 36 firmly abuts interior side 28 of container wall 24. In an exemplary embodiment, annular member 36 comprises a spanner nut. As shown in FIG. 1, annular member 36 includes notches 38 for the placement of a tool used to tighten annular member 36. Except for the openings 110 in central member 52 (see FIG. 3B), cover assembly 50 has the same structure as the cover assembly of the commercially available Model TA495 Desiccant Port manufactured by AGM Container Controls, Inc. of Tucson, AZ. Annular housing 30 and spanner nut 36 also have the same structure of the annular housing and spanner nut, respectively, of the aforesaid Model TA495 Desiccant Port.

As shown in FIGS. 1, 2, 3B, 3C and 3D, section 34 of annular housing 30 includes front opening 40 that is in communication with interior region 31. Section 32 of annular housing 30 includes rear opening 42 that is in communication with interior region 31 of annular housing 30 and interior region 25 of container 22. Front opening 40 and rear opening 42 are sized to allow passage therethrough of an electrical cable. Access port system 20 further includes cover assembly 50 that is removably attached to section 34 of annular housing 30 so as to cover front opening 40. Cover assembly 50 comprises central member 52 having front side 54 and rear side 56 that confronts interior region 31 of annular housing 30. Central member 52 has a circular shape and a first diameter. Cover assembly 50 further comprises collar 58 that is movably attached to central member 52. Collar 58 has a second diameter that is greater than the first diameter of central member 52. Central member 52 and collar 58 are concentrically arranged such that collar 58 is rotatable about central member 52. Collar 58 is configured to be removably attached to section 34 of annular housing 30. This feature is described in detail in the ensuing description.

Figure 3A:
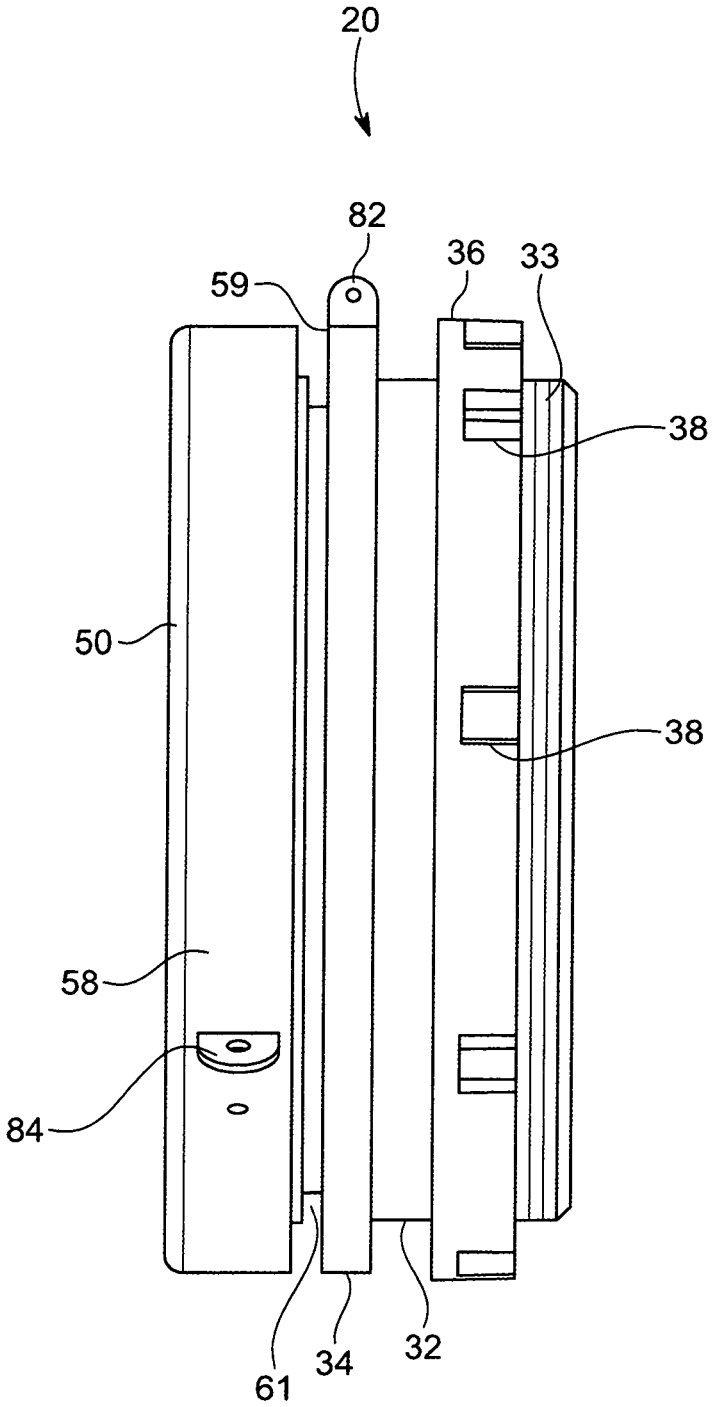
FIG. 3A is a side elevational view of the access port.
Figure 3B:
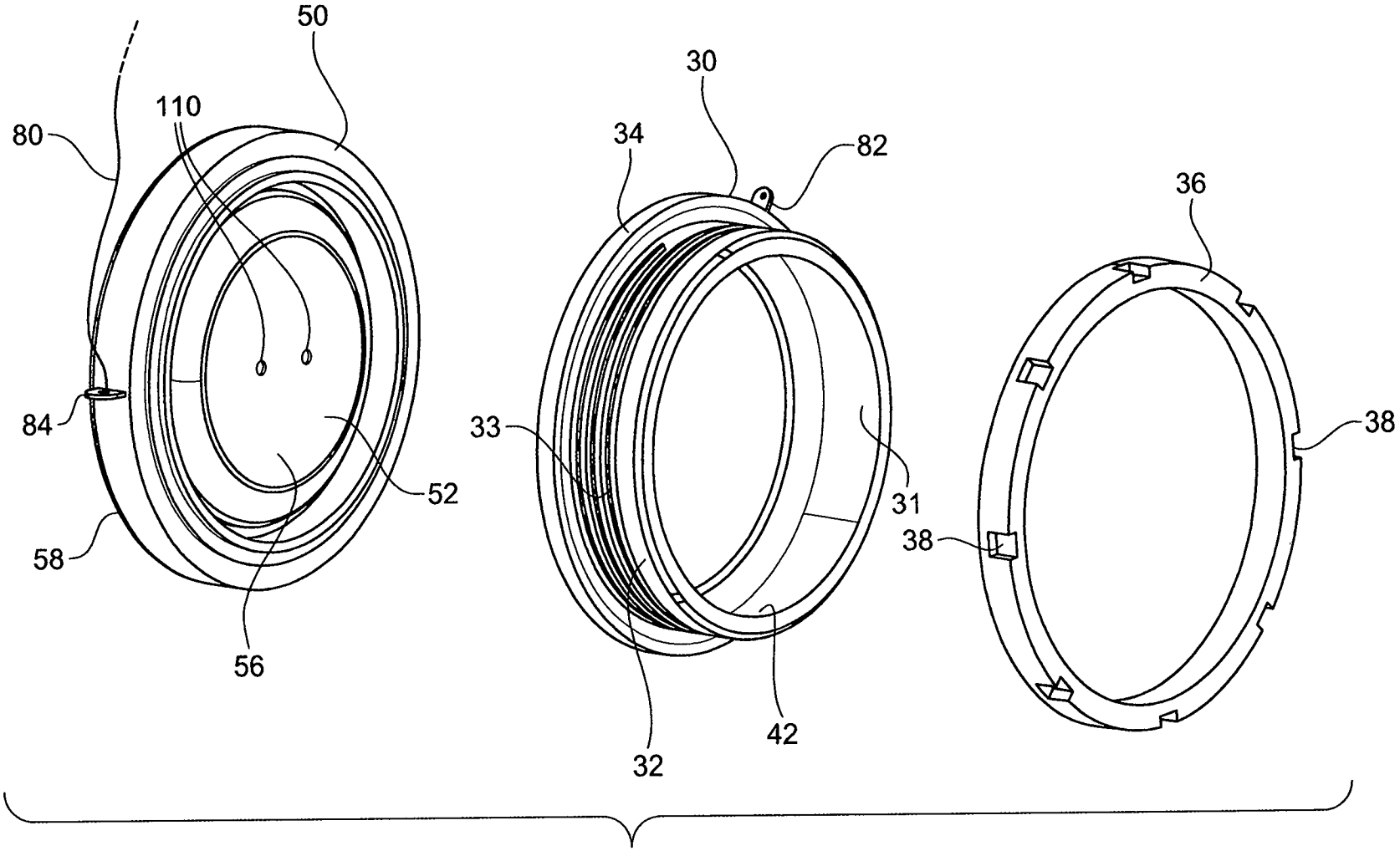
FIG. 3B is an exploded view of the access port, the view showing an annular housing, cover assembly and annular fastener member.
Figure 3C:
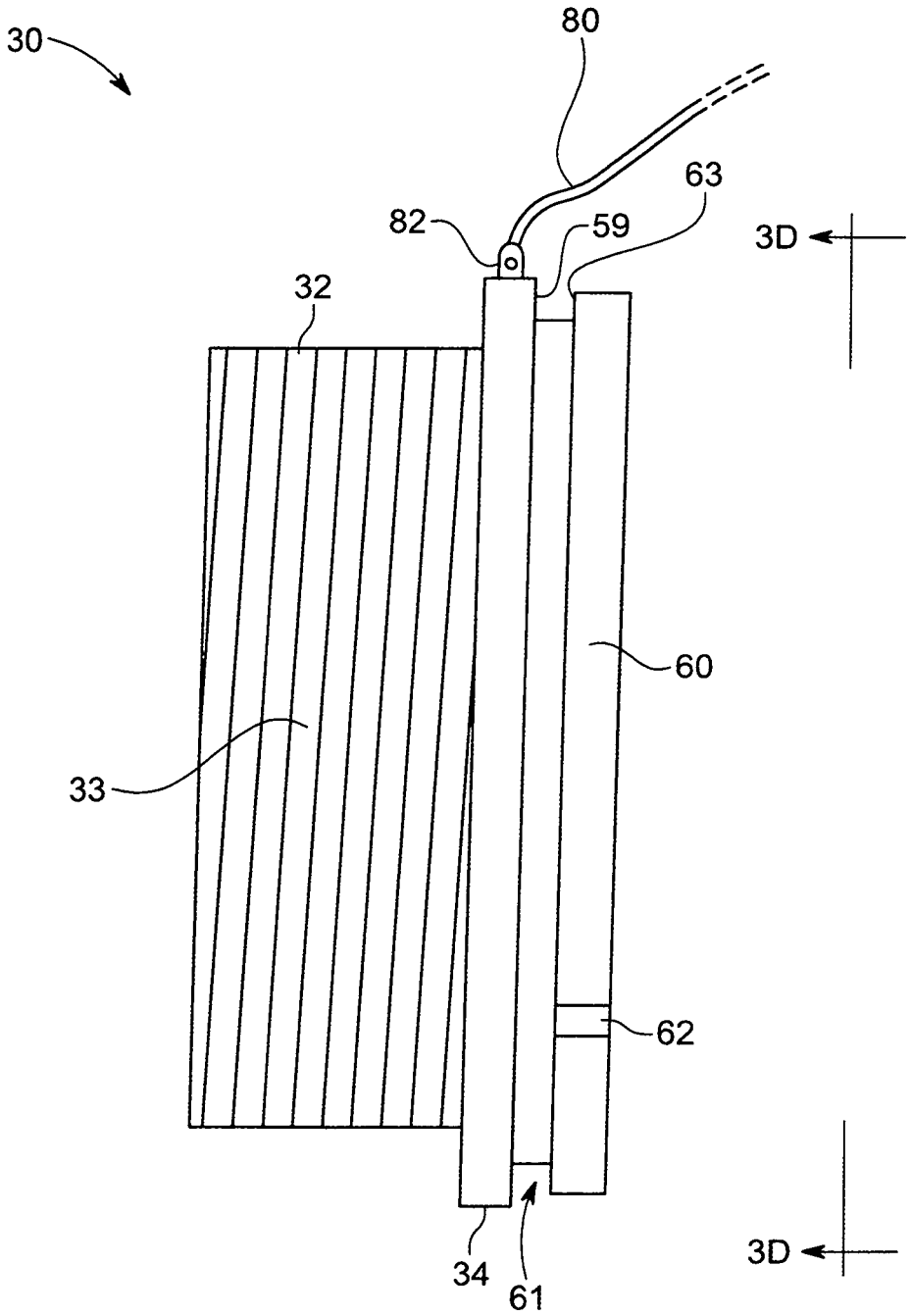
FIG. 3C is a side elevational view of the annular housing.
Figure 3D:
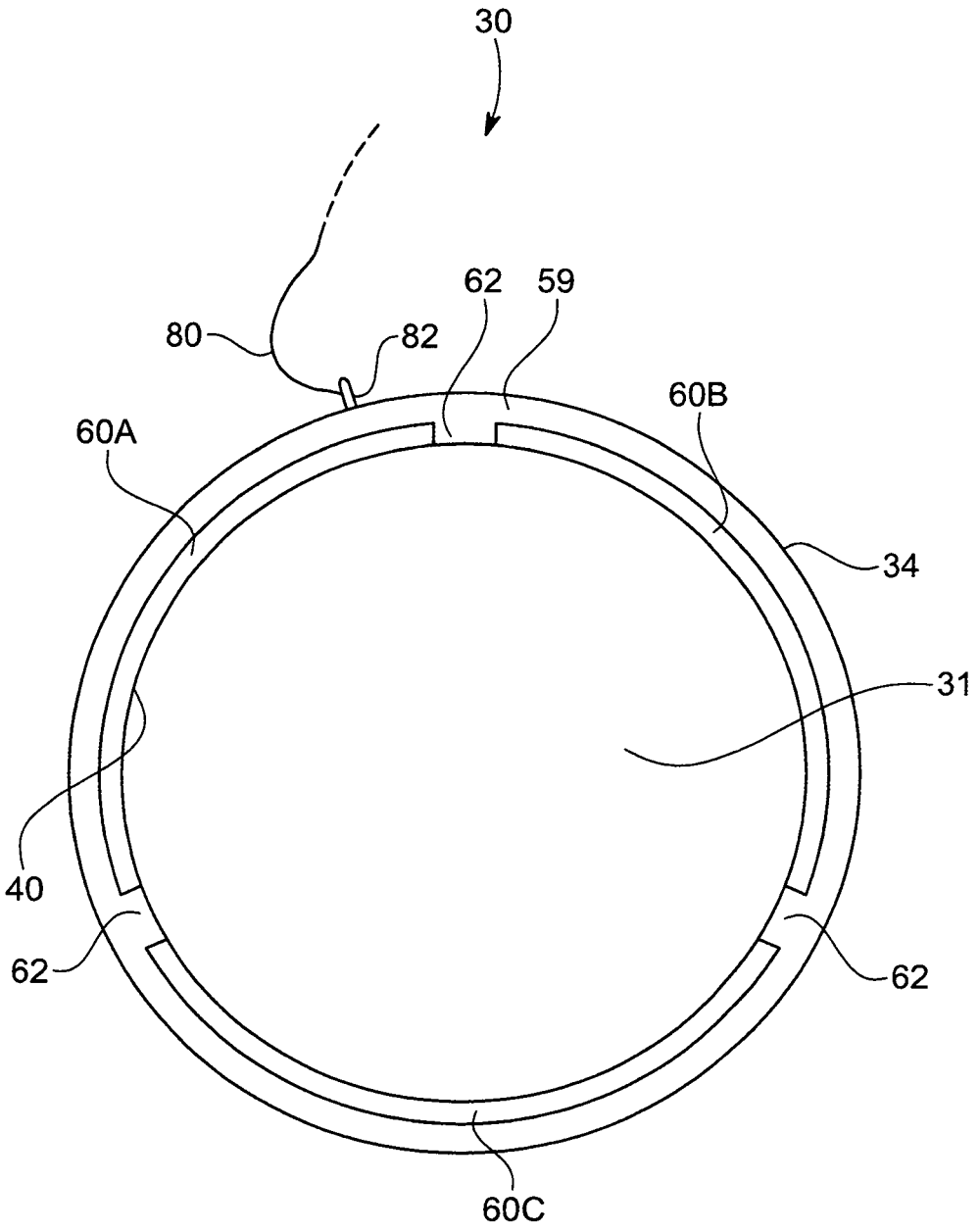
FIG. 3D is a front elevational view of a section of the annular housing taken along line 3D-3D of FIG. 3C.

As shown in FIGS. 3A, 3C and 3D, section 34 of annular housing 30 includes front surface 59 and a cover assembly engagement structure which comprises structure sections 60A, 60B and 60C. Structure sections 60A, 60B and 60C extend outward from front surface 59. This configuration provides space 61 between front surface 59 and each section 60A, 60B and 60C. The purpose of spaces 61 is discussed in the ensuing description. In some exemplary embodiments, structure sections 60A, 60B and 60C are integrally formed with section 34 of annular housing 30. In other embodiments, structure sections 60A, 60B and 60C are joined or attached to front surface 59. Structure sections 60A, 60B and 60C are spaced apart to provide a plurality of gaps 62. In an exemplary embodiment, there are three equidistantly spaced structure sections 60A, 60B and 60C so as to provide equidistantly spaced gaps 62. The purpose of gaps 62 is discussed in the ensuing description. In order to simplify the views shown in FIGS. 11 and 12, structure sections 60A, 60B and 60C are not shown in FIGS. 11 and 12.

Figure 3E:
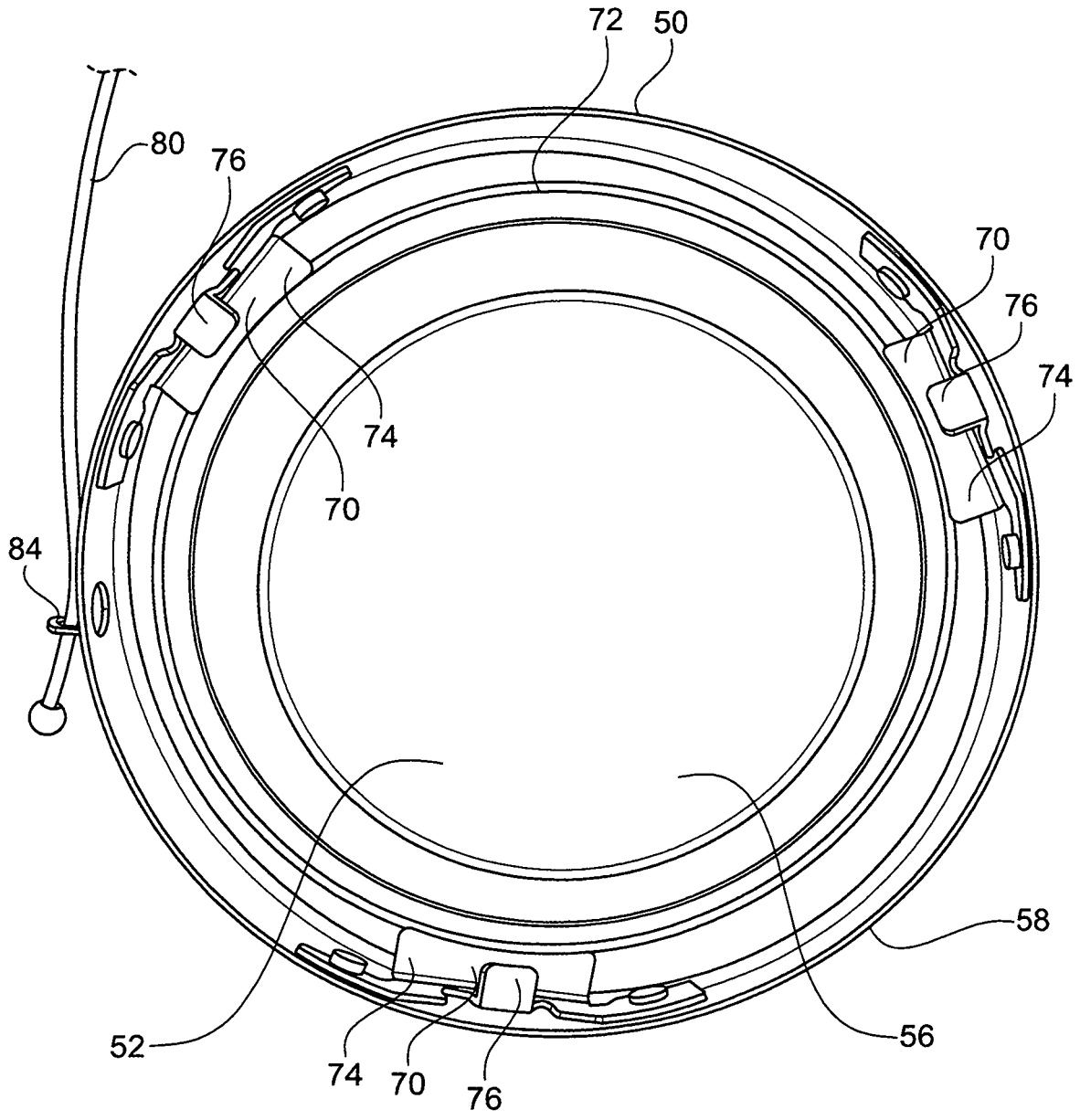
FIG. 3E is a plan view of the rear side of the cover assembly shown in FIGS. 3A and 3B.
Figure 3F:
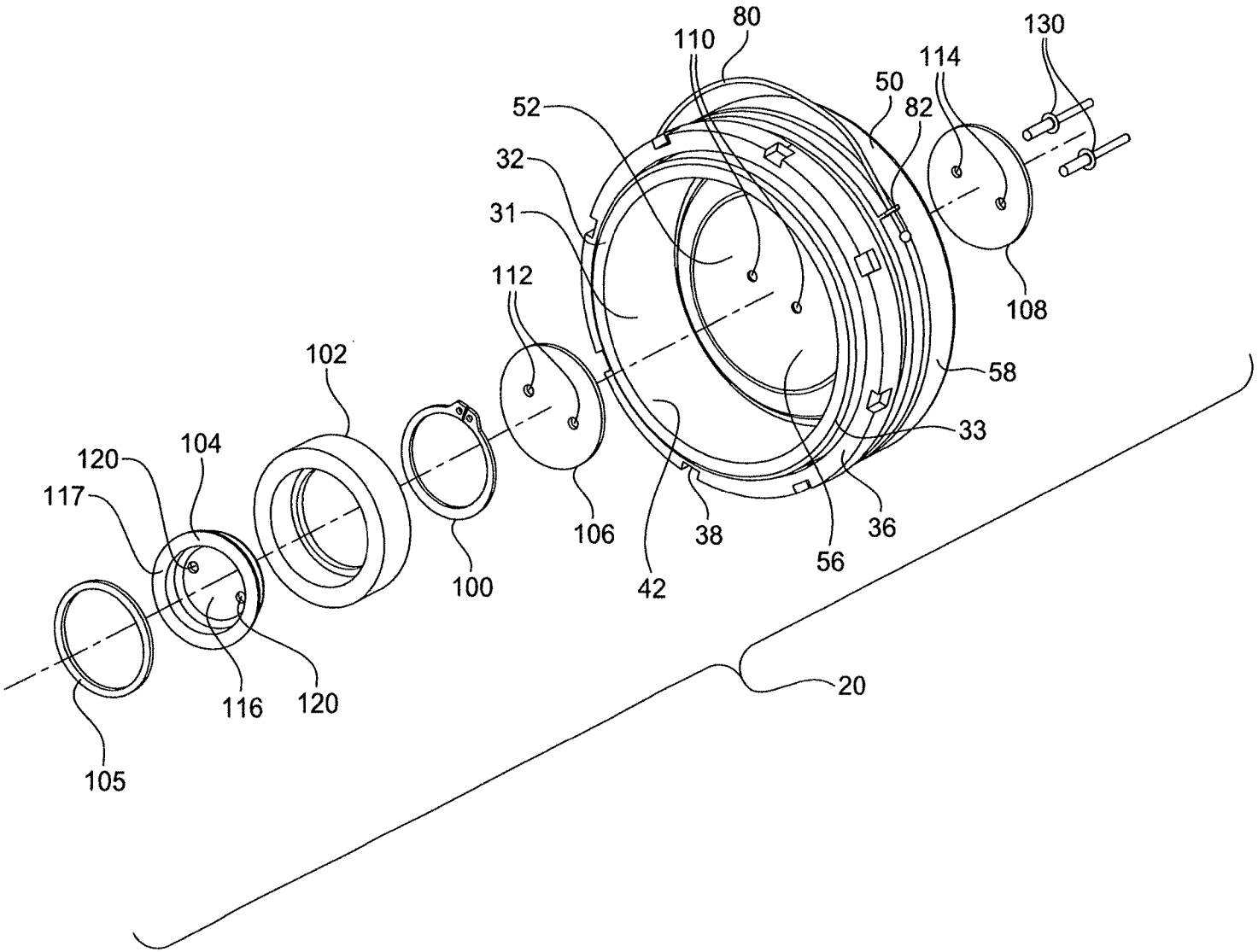
FIG. 3F is an exploded view showing the components of the electrical signal connector receptacle assembly.

As shown in FIGS. 1 and 3E, central member 52 is recessed with respect to collar 58. Collar 58 is movably attached to central member 52 via brackets 70. Brackets 70 are attached to and located on rear surface 72 of collar 58 as shown in FIG. 3E. In an exemplary embodiment, there are three equidistantly spaced brackets 70. Brackets 70 are configured to allow collar 58 to rotate with respect to central member 52. Each bracket 70 has base portion 74 and hook portion 76. Each hook portion 76 extends outwardly from base portion 74. In order to attach cover assembly 50 to section 34 of annular housing 30, a technician maneuvers cover assembly 50 so that each hook portion 76 is aligned with a corresponding gap 62 and rear surface 72 of collar 58 contacts a corresponding structure section 60A, 60B and 60C. The user then rotates collar 58 so that each hook portion 76 is positioned within space 61 and behind a corresponding structure section 60A, 60B and 60C. As collar 58 is rotated, the rear surface 72 slides upon structure sections 60A, 60B and 60C. Central member 52 does not rotate with respect to collar 58. Once hook portions 76 are behind the structure sections 60A, 60B and 60C, cover assembly 50 is removably secured to section 34 of annular housing 30. In order to remove cover assembly 50, the technician may rotate collar 58 either clockwise or counterclockwise until each hook portion 76 is aligned with a corresponding gap 62. The technician then simply pulls cover assembly 50 away from section 34 of annular housing 30.

Cover access port 20 includes flexible member 80 that is attached to cover assembly 50 and section 34 of annular housing 30. In order to simplify the drawings, flexible member 80 is not shown in all of the drawings. However, flexible member 80 is shown in FIGS. 3C, 3D, 3E, and 8-12. When cover assembly 50 is removed from section 34 of annular housing 30, cover assembly 50 will remain attached to section 34 by flexible member 80 in order to prevent cover assembly 50 from being lost or damaged. Section 34 of annular housing 30 includes first extending tab 82 to which one end of flexible member 80 is attached. Collar 58 includes second extending tab 84 to which the opposite end of flexible member 80 is attached. Flexible member 80 may be any one of a variety of flexible materials including, but not limited to, metal wire, metal cable, leather or metal strap, nylon line, string and rope.

Referring to FIGS. 2, 3F, 4A, 4B, 5A, 5B, 6A-D and 10-12, access port system 20 further includes an electrical signal connector receptacle assembly that generally comprises external retaining ring 100, connector ring 102, annular mounting member 104, O-ring 105, gasket 106 and plate member 108. In an exemplary embodiment, gasket 106 and plate member 108 have a substantially circular shape. In an exemplary embodiment, gasket 106 is fabricated from silicone rubber and plate member 108 is fabricated from metal. Central member 52 has openings or holes 110. Gasket 106 has openings or holes 112 that are configured for alignment with holes 110 of central member 52 when gasket 106 is position against rear side 56 of central member 52. Similarly, plate member 108 has openings or holes 114 that are configured for alignment with openings or holes 110 in central member 52 when plate member 108 is positioned against front side 54 of central member 52.

Figure 4A:
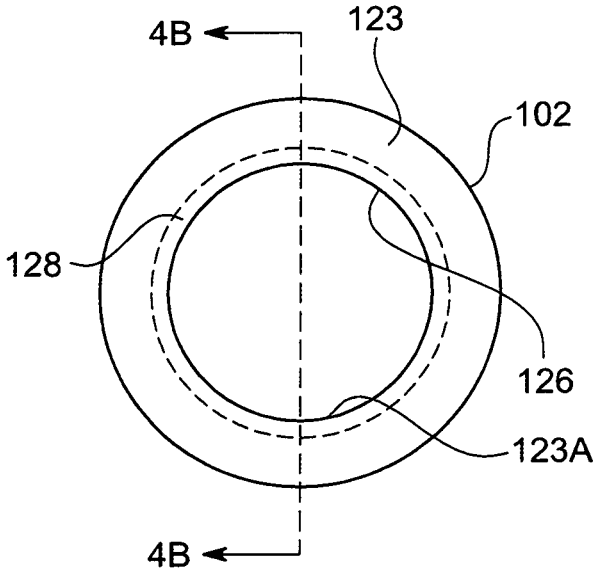
FIG. 4A is a rear, elevational view of a connector ring shown in FIG. 3F.
Figure 4B:
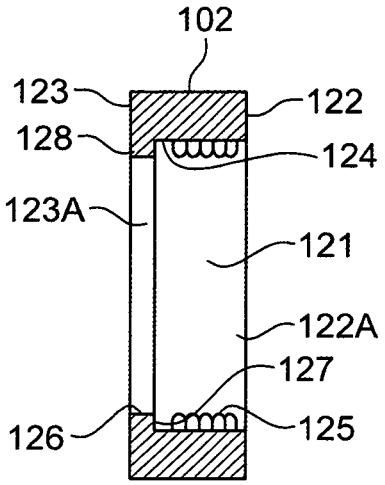
FIG. 4B is a cross-sectional view taken along line 4B-4B of FIG. 4A.
Figure 5A:
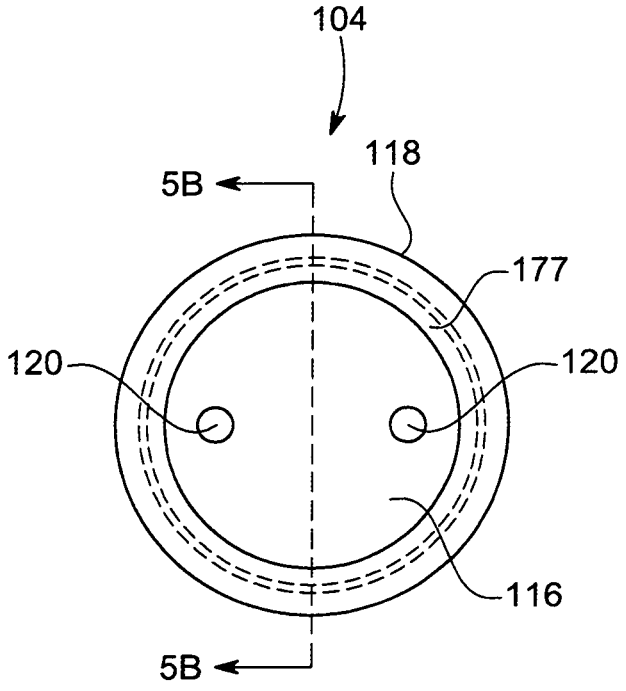
FIG. 5A is a front, elevational view of a mount that is part of a electrical signal connector receptacle assembly shown in FIG. 2.
Figure 5B:
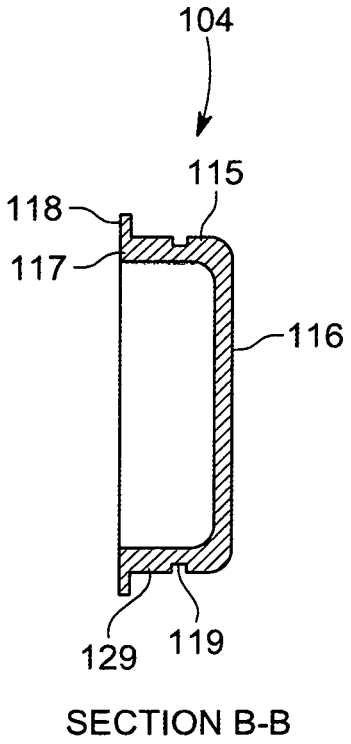
FIG. 5B is a cross-sectional view taken along line 5B-5B of FIG. 5A.
Figure 6A:
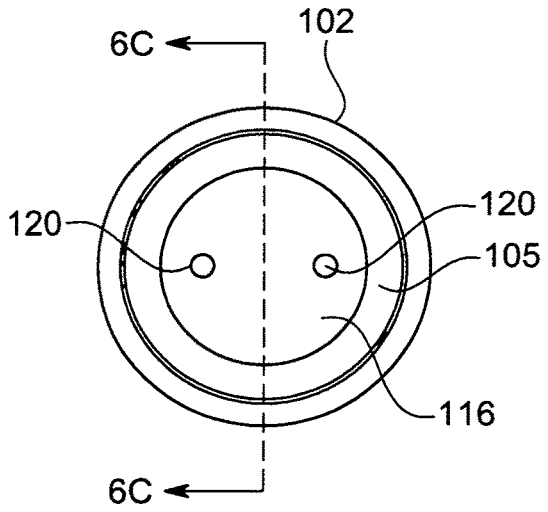
FIG. 6A is a front elevational view of an assembled electrical signal connector receptacle assembly that comprises the connector ring, mount, external retaining ring and O-ring gasket, all of which also being shown in FIG. 3F.
Figure 6B:
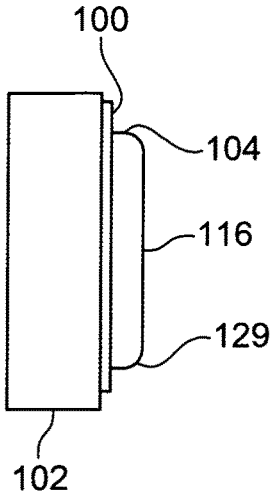
FIG. 6B is a side elevational view of the assembled electrical signal connector receptacle assembly.
Figure 6C:
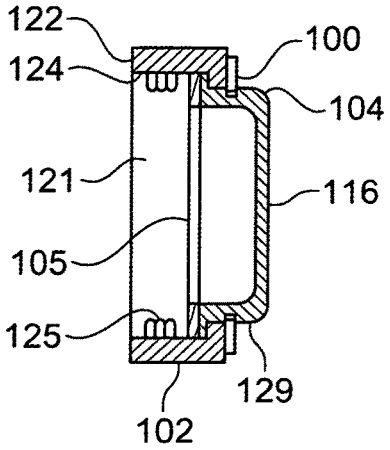
FIG. 6C is a cross-sectional view taken along line 6C-6C of FIG. 6A.
Figure 6D:
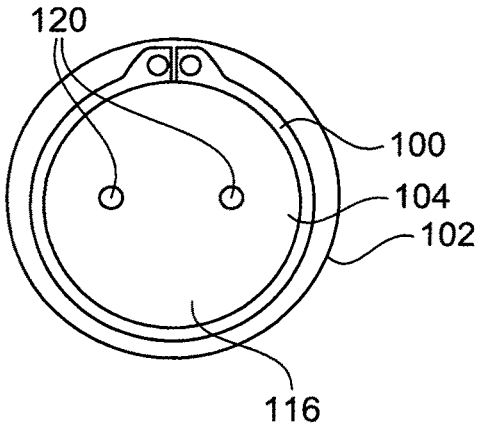
FIG. 6D is a rear elevational view of the assembled electrical signal connector receptacle assembly.

As shown in FIGS. 2, 5A, 5B and 10, mounting member 104 is attached to rear side 56 of central member 52. Mounting member 104 may be fabricated from any suitable material, e.g. metal, plastic, resin, PVC (polyvinylchloride), polycarbonate, composite material, etc. Mounting member 104 is annular in shape and has circumferentially extending surface 115 and wall section 116. Mounting member 104 includes front end 117 which comprises circumferentially extending flange portion 118. Circumferentially extending surface 115 has circumferentially extending groove 119 therein. The purposes of front end 117, flange portion 118 and groove 119 are discussed in the ensuing description. Mounting member 104 includes openings or through-holes 120 that are aligned with openings 112 in gasket 106. Referring to FIGS. 4A and 4B, connector ring 102 has an interior region 121 that is sized for receiving mounting member 104 and at least a portion of electrical connector 202 of BIT cable 200. Connector ring 102 includes front end 122 which has front opening 122A and rear end 123 which has rear opening 123A. Connector ring 102 further includes interior wall 124 that extends about interior region 121. Interior wall 124 has threaded surface 125 that is configured for threaded engagement with threads 204 of electrical connector 202 (see FIG. 10). Connector ring 102 also includes flange 126 that inwardly extends from interior wall 124 and is contiguous with rear end 123. Flange 126 has interior side 127 and exterior side 128. The purpose of flange 126 is discussed in the ensuing description. Referring to FIGS. 2, 6A-D and 11-12, mounting member 104 is positioned within interior region 121 of connector ring 102. Flange 118 of mounting member 104 abuts interior side 127 of flange 126 (see FIG. 6C) and portion 129 of mounting member 104 extends through rear opening 123A of connector ring 102 so that circumferentially extending groove 119 is external to interior region 121 of connector ring 102. As shown in FIGS. 6A and 6C, O-ring 105 is positioned within interior region 121 and abuts front end 117 of mounting member 104. Electrical connector 202 of BIT cable 200 abuts O-ring 105 when electrical connector 202 is completely connected to connector ring 102. Referring to FIGS. 6B-D, external retaining ring 100 is positioned within circumferentially extending groove 119 and abuts or is adjacent to both exterior side 128 of inwardly extending flange 126 and rear end 123 of connector ring 102. The particular location of groove 119 and the configurations of groove 119 and external retaining ring 100 are such that the connector ring 102 is rotatable with respect to mounting member 104.

Referring to FIGS. 1, 2, 3F and 6A-D, fastener members 130 are disposed through openings 114 in plate member 108, openings 110 in central member 52, openings 112 in gasket 106 and openings 120 in mounting member 104 so as to fasten these components together. Gasket 106 is positioned between rear side 56 of central member 52 and wall section 116 of mounting member 104. The completed assembly is shown in FIGS. 2 and 7-12. Connector ring 102 is rotatable with respect to central member 52 and the mounting member 104 while the mounting member 104 is held stationary by fastener members 130. In an exemplary embodiment, fastener members 130 are rivets. However, in other embodiments, fastener members 130 may be screws, pins or similar devices.

Figure 7:
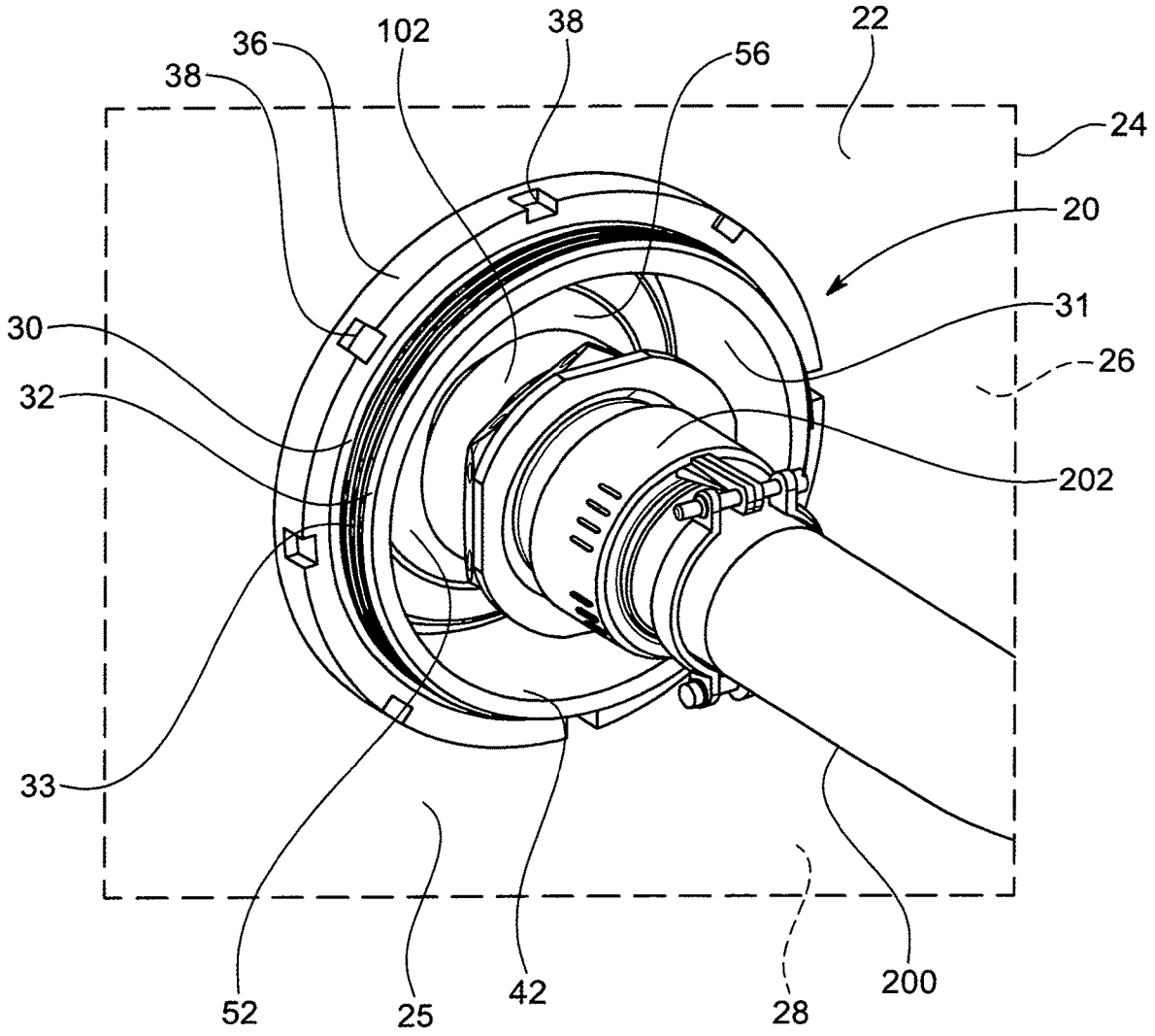
FIG. 7 is a perspective view showing the interior side of the container wall and an electrical test cable removably connected to the connector ring of the electrical signal connector receptacle assembly.
Figure 8:
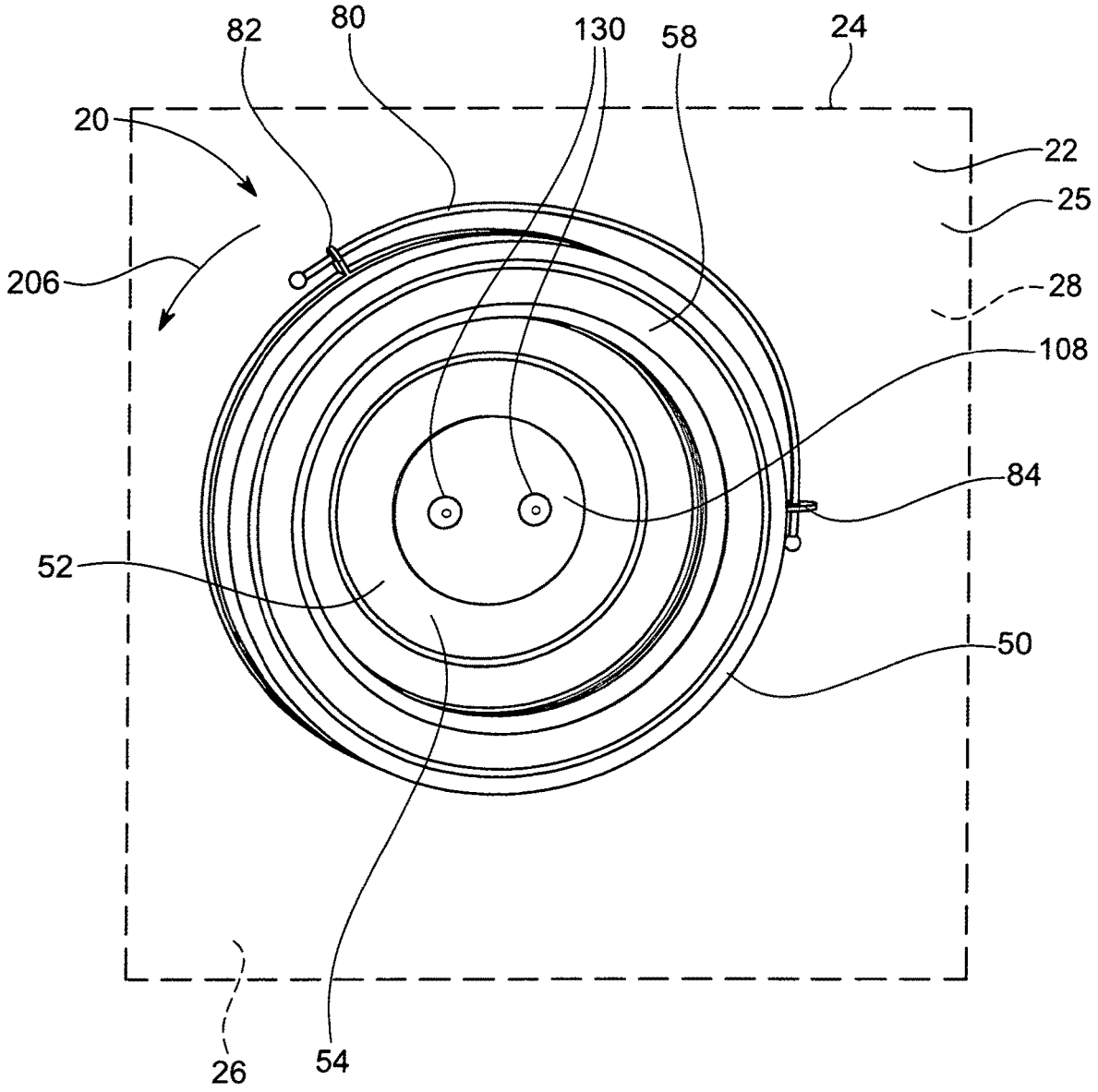
FIG. 8 is a perspective view of the exterior side of the container wall and the cover assembly of the access port, the view illustrating a rotational direction of the collar for removing the cover assembly from the annular housing of the access port.
Figure 9:
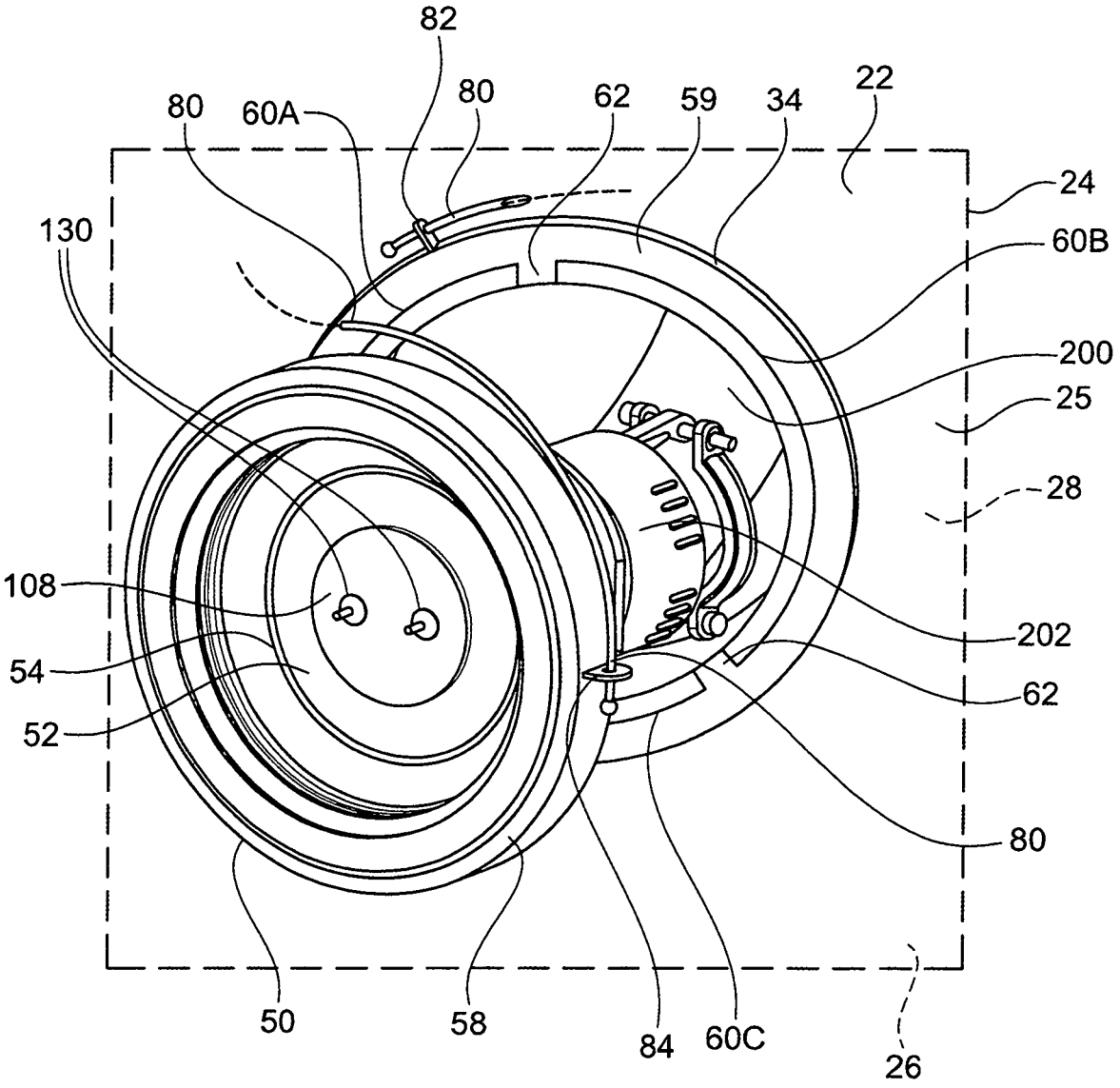
FIG. 9 is a perspective view showing the cover assembly removed from the annular housing and a portion of the electrical cable withdrawn from the interior of the container.
Figure 10:
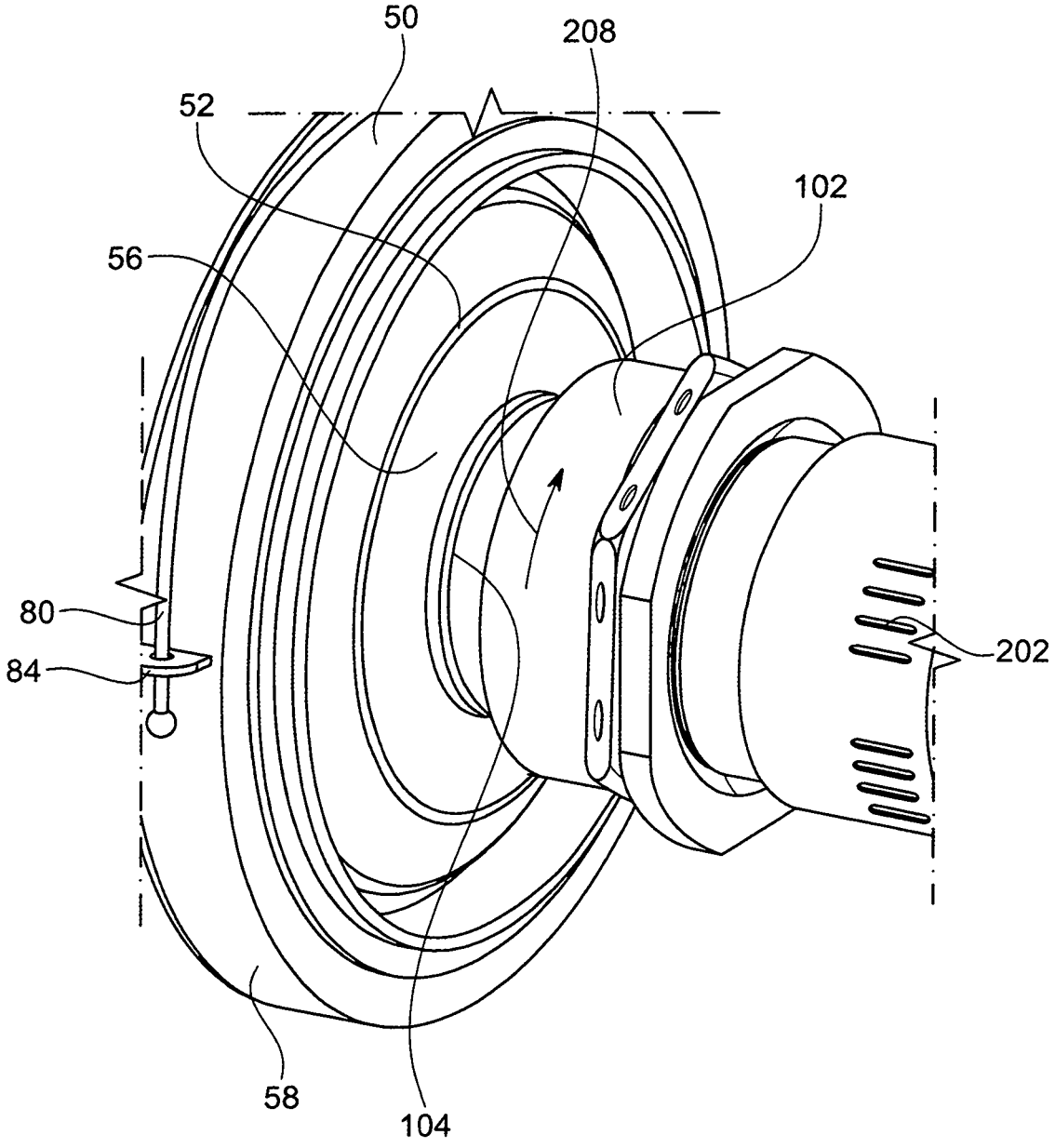
FIG. 10 is a perspective view illustrating a rotational direction of the connector ring in order to disconnect the electrical connector of the electrical test cable from the connector ring.
Figure 11:
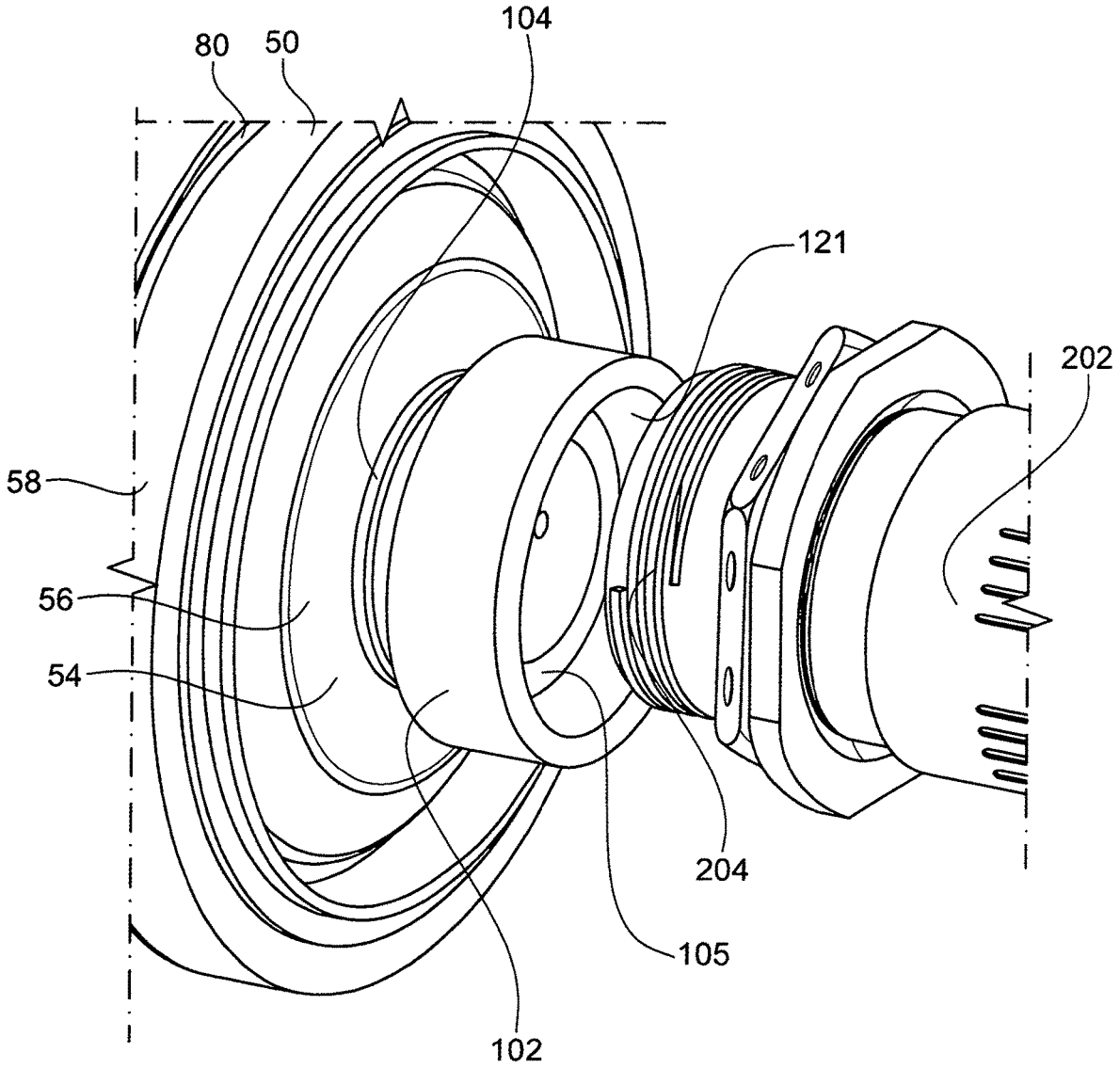
FIG. 11 is a perspective view illustrating the complete disconnection of the electrical connector from the connector ring after rotation of the connector ring in the rotational direction shown in FIG. 10.
Figure 12:
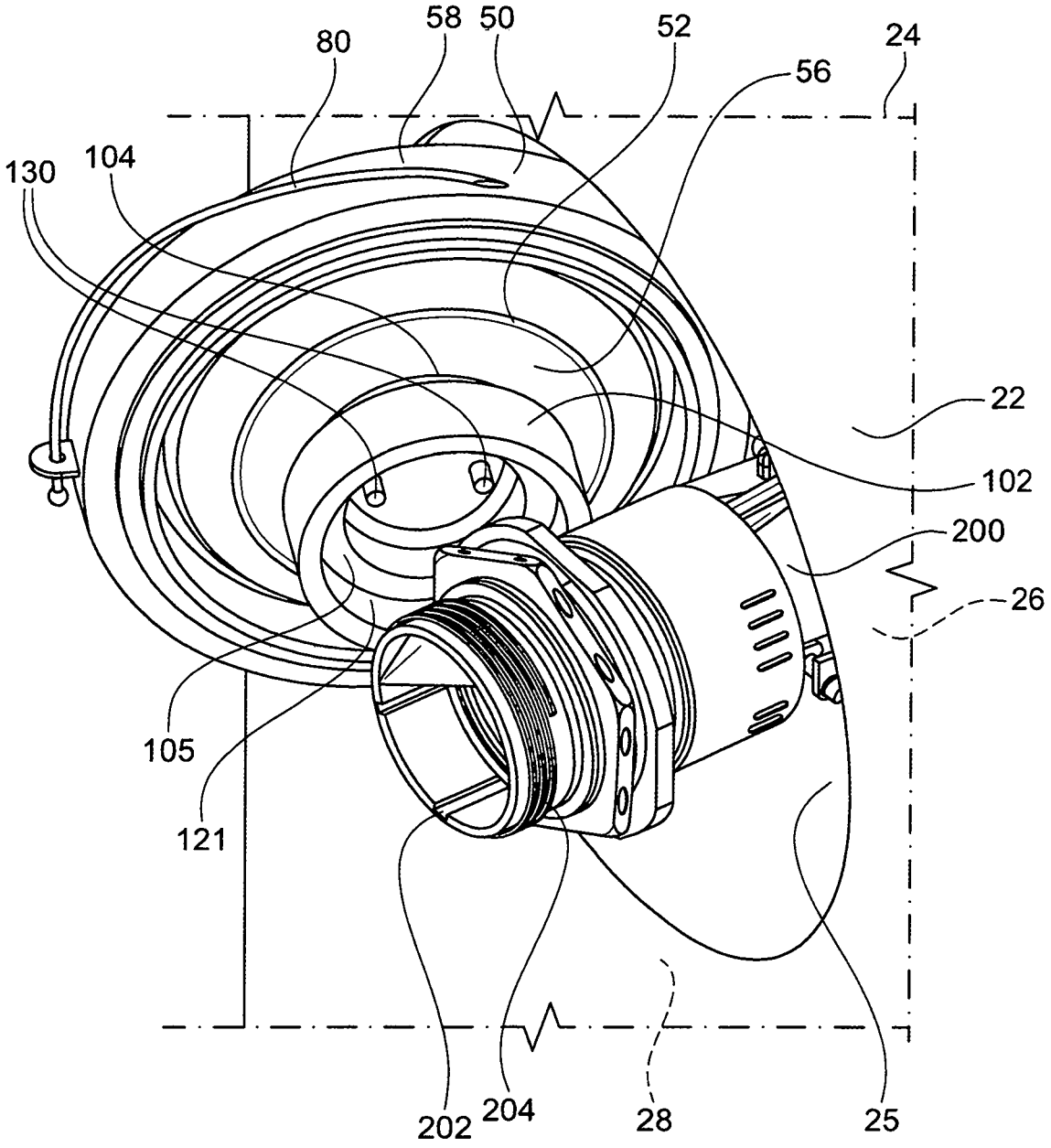
FIG. 12 is a perspective view showing the electrical connector of the electrical test cable completely disconnected from the connector ring.

FIG. 7 is a perspective view showing interior region 25 of container wall 24 and BIT (Built-In Test) cable 200 that is located within interior region 25 and removably connected to rotatable connector ring 102. BIT cable 200 includes electrical connector 202 that has outer threads 204 thereon (see FIG. 11). Threads 204 are threadedly engaged with threads 125 of connector ring 102. Referring to FIG. 8, in order to withdraw BIT cable 200 from interior region 25 of container 22, the user rotates collar 58 counter-clockwise one-quarter turn, as indicated by arrow 206, until hook portions 76 are aligned with corresponding gaps 62. The user then pulls cover assembly 50 outward so that cover assembly 50 becomes disengaged from section 34 of annular housing. Referring to FIG. 9, since electrical connector 202 of BIT cable 200 is still connected to connector ring 102, BIT cable 200 is withdrawn from interior region 25 of container 22 as cover assembly 50 is moved away from section 34 of annular housing 30. As a result, electrical connector 202 is now located outside of interior region 25. Referring to FIG. 10, the technician then rotates connector ring 102 clockwise, as indicated by arrow 208, so as to unscrew connector ring 102 from electrical connector 202. FIG. 11 shows electrical connector 202 completely disconnected from connector ring 102. Referring to FIG. 12, once connector ring 102 is unscrewed from electrical connector 202, the electrical connector 202 can be connected to external test equipment (not shown) in order to perform diagnostic testing of the electronic system (not shown) that is within container 22. In order to simplify the view of FIG. 12, section 34 of annular housing 30 is not shown. Once the BIT cable 200 is separated from cover assembly 50, the cover assembly 50 will dangle by flexible member 80. Once the testing of the electronic system within container 22 is complete, the technician then re-attaches electrical connector 202 of BIT cable 200 to connector ring 102. This method is accomplished by screwing connector ring 102 counter-clockwise back onto electrical connector 202. The technician maneuvers cover assembly 50 toward front opening 40 of section 34 of annular housing 30 so that BIT cable 200 is pushed back into interior region 25 of container 22. The technician maneuvers cover assembly 50 so that each hook portion 76 is positioned within a corresponding gap 62. The technician then rotates collar 58 clockwise one-quarter turn so that each hook portion 76 is secure within space 61 that is between a corresponding structural section 60A, 60B and 60C and front surface 59 of section 34 of annular housing 30. Cover assembly 50 is now securely attached to section 34 of annular housing 30.

Therefore, access port system 20 allows withdrawal of BIT cable 200 from interior region 25 of container 22 without the technician having to open or disassemble container 22 in order to retrieve the electrical test cable or without having to insert his or her hand into interior region 25. Access port system 20 reduces the amount of time needed to perform diagnostic testing or updating of the electronic system within container 22.

Components of access port system 20, such as annular housing 30, cover assembly 50 and the spanner nut 36, may be inexpensively manufactured from a variety of materials, including but not limited to, metal, plastic, resin, PVC (polyvinylchloride), polycarbonate and composite materials.

The foregoing description of illustrated exemplary embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. An electrical signal connector receptacle assembly, comprising:

a substantially annular mounting member being configured for attaching to a structure so that the mounting member is stationary with respect to the structure, wherein the mounting member includes a front end having a front opening and a rear portion; and a connector ring being rotatably attached to the mounting member such that the connector ring rotates with respect to the mounting member, wherein the connector ring is configured to be removably attached to the electrical signal connector, wherein the connector ring includes an interior region within which the mounting member is located, wherein the connector ring further includes a front end having a front opening and a rear end having a rear opening, wherein the rear portion of the mounting member extends through the rear opening of the connector ring and is configured to be attached to the structure, wherein the rear end of the connector ring includes an inwardly extending flange portion that extends about the rear opening of the connector ring, wherein the inwardly extending flange portion includes an interior side and an exterior side, and wherein the interior side is within the interior region of the connector ring.

2. The electrical signal connector receptacle assembly according to claim 1, wherein the connector ring further includes an interior wall extends about the interior region of the connector ring and includes a threaded surface configured to be threadedly engaged with a corresponding threaded surface of the electrical signal connector.

3. The electrical signal connector receptacle assembly according to claim 1, wherein the front end of the mounting member includes a circumferentially extending flange that extends about the front opening of the mounting member and abuts the interior side of the inwardly extending flange portion of the connector ring, wherein the rear portion of the mounting member that extends through the rear opening of the connector ring is configured with a circumferentially extending groove, and wherein the circumferentially extending groove includes a retainer ring disposed within and adjacent to the exterior side of the inwardly extending flange portion of the connector ring.

4. The electrical signal connector receptacle assembly according to claim 1, further comprising an O-ring gasket being situated within the interior region of the connector ring and abutting the front end of the mounting member, wherein the O-ring gasket is configured to contact the electrical signal connector when the connector ring is completely attached to the electrical signal connector.

5. The electrical signal connector receptacle assembly according to claim 1, further comprising a gasket for placement between the mounting member and the structure.

6. A system, comprising:

an annular housing being configured for removably mounting within an opening in a container wall, wherein the annular housing includes a front opening, a rear opening and an interior region in communication with the front opening and rear opening, and wherein the front opening, rear opening and interior region are sized to allow passage therethrough of an electrical cable;

an annular fastener member being removably attached to the annular housing for retaining the annular housing within the opening in the container wall;

a cover assembly being removably attached to the annular housing for covering the front opening, wherein the cover assembly includes a central member having a front side and a rear side, which confronts the interior region of the annular housing; and an electrical signal connector receptacle being assembly attached to the rear side of the central member such that the electrical signal connector receptacle assembly is located within the interior region of the annular housing, wherein the electrical signal connector receptacle assembly includes a connector ring configured to be removably attached to an electrical signal connector of the electrical cable.

7. The system according to claim 6, further comprising an access port, wherein the connector ring includes an interior region, an interior wall extending about the interior region, a front end having a front opening and a rear end having a rear opening, wherein the rear end includes an inwardly extending flange portion that extends about the rear opening, wherein the inwardly extending flange portion includes an interior side within the interior region of the connector ring and an exterior side, wherein the interior wall includes a threaded surface thereon configured for threaded engagement with a threaded surface of the electrical signal connector, wherein the electrical signal connector receptacle assembly further comprises a mounting member positioned within the interior region of the connector ring and includes a front end having a front opening, and wherein the mounting member includes a portion extending through the rear opening of the connector ring and attached to the rear side of the central member such that the connector ring is rotatable with respect to the mounting member.

8. The system according to claim 7, wherein the front end of the mounting member includes a circumferentially extending flange that extends about the front opening of the mounting member and abuts the interior side of the inwardly extending flange portion of the connector ring, wherein the portion of the mounting member extends through the rear opening of the connector ring configured with a circumferentially extending groove, and wherein the connector receptacle assembly further includes a retaining ring disposed within the circumferentially extending groove and adjacent to the exterior side of the inwardly extending flange portion of the connector ring.

9. The system according to claim 7, wherein the electrical signal connector receptacle assembly further includes an O-ring gasket abutting the front end of the mounting member and configured to contact the electrical signal connector when the connector ring is completely attached to the electrical signal connector.

10. The system according to claim 7, wherein the electrical signal connector receptacle assembly further includes a gasket rigidly positioned between the rear side of the central member of the cover assembly and the portion of the mounting member that extends through the rear opening of the connector ring.

11. The system according to claim 7, wherein the central member includes at least one through-hole therein that is sized to receive a fastener and wherein the portion of the mounting member that extends through the rear opening of the connector ring has at least one through-hole therein that is aligned with the at least one through-hole in the central member, wherein the access port further comprises a plate member and a fastener, wherein the plate member is positioned against the front side of the central member, wherein the plate member has at least one through-hole therein that is aligned with the at least one through-hole in the central member, and wherein the fastener is disposed through the through-holes in the plate member, central member and mounting member so as to rigidly attach the mounting member to the rear side of the central member.

12. The system according to claim 6, wherein the central member has a circular shape and a first diameter, wherein the cover assembly further includes a collar movably attached to the central member and includes a second diameter greater than the first diameter, and wherein the central member and collar is concentrically arranged such that the collar is rotatable about the central member, whereby rotating the collar in one direction allows the cover assembly to be removed from the annular housing so as to expose the front opening of the annular housing and rotates the collar in an opposite second direction to allow the cover assembly to be secured to the annular housing.

13. The system according to claim 12, further comprising a flexible member being attached to the collar and the annular housing, wherein the cover assembly remains attached to the annular housing when the cover assembly is removed from the annular housing thereby to prevent the cover assembly from becoming at least one of lost and damaged.

14. A system, comprising:

an annular housing being configured to be removably mounted within an opening in a container wall, wherein the annular housing includes a front opening, a rear opening and an interior region in communication with the front opening and rear opening, and wherein the front opening, rear opening and interior region are sized to allow passage therethrough of an electrical cable having an electrical signal connector;

an annular fastener member being removably attached to the annular housing for retaining the annular housing within the opening in the container wall;

a cover assembly being removably attached to the annular housing for covering the front opening, wherein the cover assembly includes a central member having a front side and a rear side that confronts the interior region of the annular housing, wherein the central member has a circular shape and a first diameter, wherein the cover assembly further comprises a collar movably attached to the central member and includes a second diameter greater than the first diameter, wherein the central member and collar are concentrically arranged such that the collar is rotatable about the central member, wherein the collar is removably attached to the annular housing, and wherein the collar and the annular housing are configured to allow the cover assembly to be removed from the annular housing by rotating the collar in a first direction and secured to the annular housing by rotating the collar in an opposite second direction;

a flexible member being attached to the collar and the annular housing so that the cover assembly remains attached to the annular housing when the cover assembly is removed from the annular housing so as to prevent the cover assembly from becoming one of lost and damaged; and an electrical signal connector receptacle assembly being attached to the rear side of the central member such that the electrical signal connector receptacle assembly is located within the interior region of the annular housing, wherein the electrical signal connector receptacle assembly includes a connector ring configured to be removably attached to the electrical signal connector of the electrical cable.

15. The system according to claim 14, wherein the connector ring includes an interior region, an interior wall extending about the interior region, a front end having a front opening and a rear end having a rear opening, wherein the rear end includes an inwardly extending flange portion that extends about the rear opening, wherein the inwardly extending flange portion has an interior side within the interior region of the connector ring and an exterior side, wherein the interior wall includes a threaded surface configured to be threadedly engaged with a threaded surface of the electrical signal connector, wherein the electrical signal connector receptacle assembly further comprises a mounting member positioned within the interior region of the connector ring, wherein the mounting member comprises a portion that extends through the rear opening of the connector ring and is attached to the rear side of the central member such that the connector ring is rotatable with respect to the mounting member, and wherein the mounting member further comprises a front end having a front opening.

16. The system according to claim 15, wherein the mounting member further comprises an exterior circumferentially extending flange that extends about the front opening of the mounting member and which is contiguous with the front end of the mounting member, wherein the exterior circumferentially extending flange abuts the interior side of the inwardly extending flange portion of the connector ring, wherein the portion of the mounting member extends through the rear opening of the connector ring, which is configured with a circumferentially extending groove, and wherein the connector receptacle assembly further comprises a retaining ring disposed within the circumferentially extending groove and adjacent to the exterior side of the inwardly extending flange portion of the connector ring.

17. The system according to claim 15, wherein the electrical signal connector receptacle assembly further includes an O-ring gasket positioned within the interior region of the connector ring and abuts the front end of the mounting member.

18. The system according to claim 15, wherein the electrical signal connector receptacle assembly further includes a gasket rigidly positioned between the mounting member and the rear side of the central member of the cover assembly.

19. A container for housing an electronic system, comprising:

a plurality of container walls being configured for defining an interior region, wherein each container wall includes an interior side and an exterior side, and wherein at least one of the container walls includes an opening therein;

an electrical test cable being positioned within the interior region of the container and in electrical signal communication with the electronic system, wherein the electrical test cable includes an electrical signal connector having a threaded surface;

an access port being mounted within the opening in said at least one of the container walls, wherein the access port comprises an annular housing and an annular faster member, wherein the annular housing is mounted within the opening in said at least one of the container walls, wherein the annular housing includes a front opening, a rear opening and an interior region in communication with the front opening and the rear opening, wherein the rear opening is in communication with the interior region of the container, wherein the front opening, rear opening and interior region of the annular housing are sized to allow passage therethrough of the electrical test cable, wherein the annular housing includes a first section that is external to the interior region of the container and which has the front opening, wherein the annular housing further includes a second section located within the interior region of the container and which has the rear opening, and wherein the first section is configured to abut the exterior side of the container wall;

an annular fastener member being located within the interior region of the container and removably attached to the second section of the annular housing so as to retain the annular housing within the opening in said at least one of the container walls;

a cover assembly being removably attached to the first section of the annular housing so as to cover the front opening, wherein the cover assembly includes a central member having a front side and a rear side that confronts the interior region of the annular housing and a collar that is rotatably attached to the central member, wherein the collar is rotatable in one direction to allow the cover assembly to be removed from the first section so as to expose the front opening of the annular housing, and wherein the collar is rotatable in an opposite second direction to allow the cover assembly to be secured to the first section so as to cover the front opening of the annular housing; and an electrical signal connector receptacle assembly being attached to the rear side of the central member such that the electrical signal connector receptacle assembly is located within the interior region of the annular housing, wherein the electrical signal connector receptacle assembly includes a connector ring removably and rotatable attached to the electrical signal connector of the electrical test cable, wherein the connector ring is rotatable in a first direction with respect to the electrical signal connector to disconnect the electrical signal connector from the connector ring, wherein the connector ring is rotatable in an opposite second direction connects the connector ring to the electrical signal connector, wherein the electrical signal connector of the electrical test cable remains attached to the connector ring as the cover assembly is configured to be removed from the first section of the annular housing to withdraw the electrical test cable from the interior of the container absent a technician having to open the container in order to retrieve the electrical test cable, and wherein once the electrical signal connector of the electrical test cable is outside of the interior region of the container, the connector ring is rotatable by the technician in the first direction so as to disconnect the electrical signal connector from the connector ring in order to connect the electrical signal connector to external test equipment.

20. The container according to claim 19, wherein the connector ring includes an interior threaded surface configured for threaded engagement with the threaded surface of the electrical signal connector.

21. The container according to claim 19, wherein the connector ring includes an interior region, a front end having a front opening and a rear end having a rear opening, wherein the front opening and rear opening are in communication with the interior region, wherein the rear end includes an inwardly extending flange portion that extends about the rear opening, wherein the inwardly extending flange portion includes an interior side within the interior region of the connector ring and an exterior side, wherein the electrical signal connector receptacle assembly further comprising a mounting member and a retainer ring, wherein the mounting member is positioned within the interior region of the connector ring, wherein the mounting member has a portion that extends through the rear opening of the connector ring and which is attached to the rear side of the central member of the cover assembly, wherein the mounting member further comprises a front end within the interior region of the connector ring and a circumferentially extending flange that extends about the front opening of the mounting member and which abuts the interior side of the inwardly extending flange portion of the connector ring, wherein the portion of the mounting member extends through the rear opening of the connector ring is configured with a circumferentially extending groove, and wherein the retaining ring is disposed within the circumferentially extending groove such that the retaining ring is adjacent to the exterior side of the inwardly extending flange portion of the connector ring.

22. The container according to claim 21, wherein the electrical signal connector receptacle assembly further comprises an O-ring gasket positioned within the interior region of the connector ring and adjacent to the front end of the mounting member, and wherein the O-ring gasket is configured to abut the electrical signal connector of the electrical test cable.

23. The container according to claim 21, wherein the electrical signal connector receptacle assembly further includes a gasket rigidly positioned between the mounting member and the rear side of the central member of the cover assembly.

24. The container according to claim 19, further comprising a flexible member being attached to the collar and the first section of the annular housing so that the cover assembly remains being attached to the first section when the cover assembly is removed from the first section of the annular housing thereby preventing the cover assembly from becoming at least one lost and damaged.

* * * * *